United States Patent [19]

Filho et al.

[11] Patent Number: 5,076,082

[45] Date of Patent: Dec. 31, 1991

[54] SAFETY LOCK

[76] Inventors: José R. Filho, Rua Cabinda, 41, 03144 São Paulo, Brazil; Ezio R. Cerri, Rua Almirante Noronha, 956 - ap. 44, 02043 São Paulo, Brazil

[21] Appl. No.: 395,591

[22] Filed: Aug. 18, 1989

[30] Foreign Application Priority Data

Aug. 24, 1988 [BR] Brazil ..... PI8804299

[51] Int. Cl.[5] ..... E05B 09/08

[52] U.S. Cl. ..... 70/451; 70/370

[58] Field of Search ..... 70/451, 370, 124, 129, 70/134

[56] References Cited

U.S. PATENT DOCUMENTS 2,284,409 5/1942 Erath ..... 70/451

3,740,979 6/1973 Crepinsek ..... 70/451

*Primary Examiner*—Robert L. Wolfe

*Attorney, Agent, or Firm*—Jon C. Christiansen; David R. Black

[57] ABSTRACT

Invention patent for "Safety Lock" comprised by a mechanism (1) having a case composed of two parallel plates (2) interconnected by spacers (3), internally provided with an operating drive (4) for a latch bolt (5) and for a latch (6), this latter being also operable by means of a handle or alike, which passes through a corresponding opening (7), and, further, having a barrel block (8) incorporated in said mechanism (1) in transversal direction and being provided with a longitudinal hole or passage (9) which receives a puzzle barrel comprised by one or more rows of spring pin assemblies positioned radially with respect to two barrels (10) inserted in said passage (9), each of which has a cam configurating, eccentric and internal pin (11) which cooperates with the operating drive (4), said book (8) being retained within said mechanism by a drawer-like arrangement. The barrel block (8) is provided with a transverse channel (12) which houses cam (11) completely and leaves free a wide lower section (13), the side walls of channel (12) presenting small steps (14) along the upper edges, thereby defining guides (15) which are insertable in a corresponding aperture (16) of the said mechanism (1).

2 Claims, 1 Drawing Sheet

1/1

SAFETY LOCK

As it is generally known, there exist presently various types of locks, the majority of which comprising a mechanism containing internally a driving device for a locking bolt and a latch, said mechanism being controlled by a locking barrel located in a bedplate formed with a metallic block positioned transversely to the case, provided with a puzzle-barrel composed by one or more aligned rows of pins disposed radially with respect to the barrel or cylinder, which can be released using a corresponding key.

The locks of this configuration, though being largely in use, present two great drawbacks as regards safety, one of them being the low resistance of the block or barrel to torsion, therefore being easily broken away with the use of a pipe wrench or similar tool. This occurs because the region located inside the lock's mechanism presents a very thin transversal section in order to allow rotation of a pulling cam for the driving mechanism which controls the latch and latch bolt, with the consequent weakening of that region.

The other drawback featured by such locks of the prior art resides in that the barrel or cylinder is secured to the lock mechanism by means of an anchoring pin which penetrates into an orifice or thread provided that weakened region, so as to pivoting the barrel block transversally to the axis of the barrel block, being the only fixing means and which may be easily sheared by an impact applied lengthwise with respect to the block axis.

Furthermore, there are also known some locks of the Yale type having a split barrel block and which present greater resistance to impacts, but they may be forced open by torsion as in the first case mentioned above, since the securing areas at the mechanism are small.

Because of these drawbacks, and having in mind to solve them, it was developed the safety lock object of this invention, which features high resistance to forced collapsing, either by torsion of the block, or by impact, its construction form allowing that the block presents a transversal section of great area at the internal sector of the case, as well as providing a securing of the block by a drawer-like insertion, thereby obtaining a new concept in locks.

The annexed drawings show the safety lock object of this invention, and in which.

Figure 1:
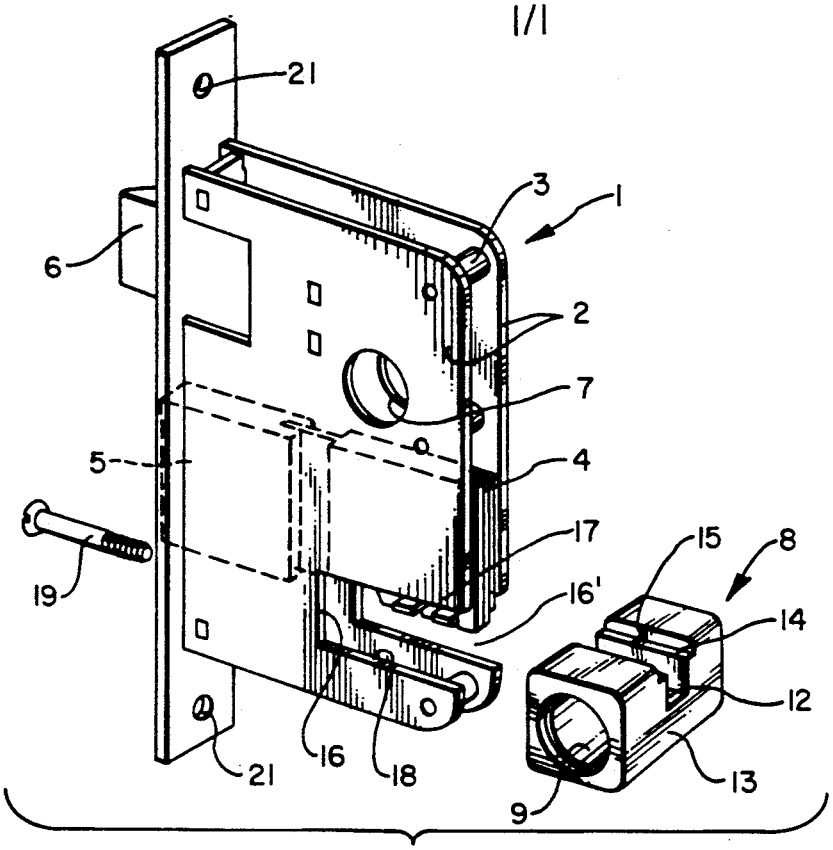
FIG. 1 shows a perspective view, with the barrel block illustrated in separate.
Figure 2:
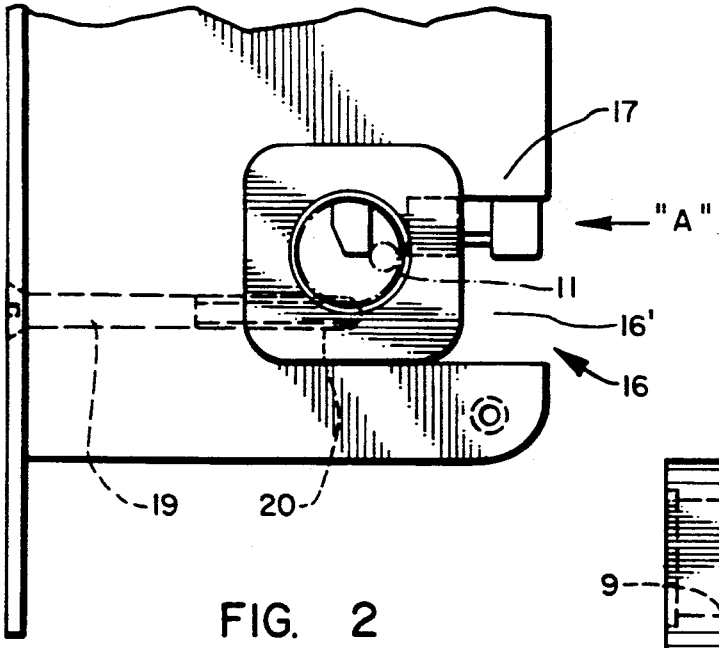
FIG. 2 shows a partial and lateral view of the same, indicating line "A"
Figure 3:
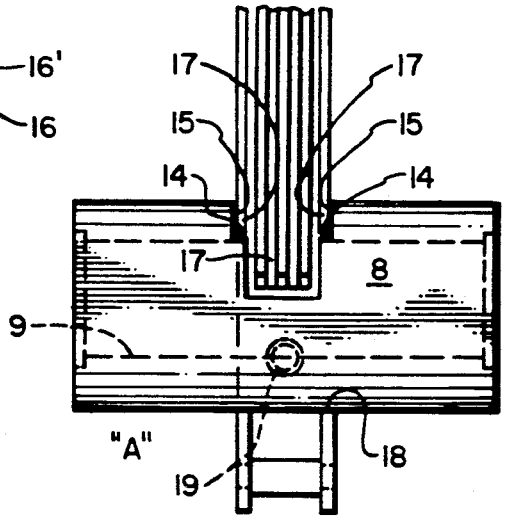
FIG. 3 is a view as indicated by line "A" of FIG. 2.

According to what is being illustrated in the above Figures, the safety lock of the invention is constituted by a mechanism 1, having a case formed by two parallel plates 2 interconnected by spacers 3 and internally provided with an operating drive 4 for a latch bolt 5 and for a latch 6, this latter also being operable by a handle or the like (not shown) passing through the corresponding hole or opening 7, and, further, having incorporated to mechanism 1 a transverse barrel block 8 provided with a longitudinal hole or passage 9, and fitted with a puzzle barrel comprised of one or more rows of spring pin assemblies (not shown) radially positioned with respect of two cylinders or barrels 10 (not shown) inserted in passage 9, each of which having an eccentric internal pin 11 configurating an interfering cam at the operating drive of latch bolt 5 and the latch 6.

By its turn, barrel block 8 is retained within the mechanism 1 by a drawer-like insertion, said barrel block 8 being provided with a transverse channel 12, so as to housing the control cam 11 completely, but leaving free a wide lower section 13. The lateral walls of channel 12 present small steps 14 along the upper edges, defined as guides 15 to be inserted in the corresponding aperture 16 on mechanism 1.

On the other hand, aperture 16 is in form of an elongated "U" disposed horizontally and into which the barrel block 8 is inserted, the guides 15 of which forming abutment surfaces and receiving therebetween the upper edges 17 of aperture 16, thereby avoiding a movement of the barrel block in the direction of its longitudinal axis, while the steps 14 impede the same to rotate because they rest at the lower ends of edges 17, with the lower face of said barrel block 8 resting on the lower side 18 of aperture 16.

The safety lock so built up is mounted on any desired door by first positioning barrel block 8 thereat, inserting it in the corresponding hole provided therein. Next, the mechanism 1 is introduced by a drawerlike movement and, finally, screw 19 is tightened so as to pull barrel block 8 by means of a threaded orifice existing on the same, until abutting the block against the vertical front side of aperture 16. Following this, fixing screws are bolted through orifices 21, what finishes the job.

It is pointed out further that with the lock of the invention, screw 19 has the only purpose of positioning the barrel block; therefore, it is not subject to any stress and has no other function with respect to safety of the lock.

The safety lock of this invention may, of course, be made with the most variable materials, in any other forms or disposition, without departing from the scope herein foreseen for patent protection.

We claim:

1. SAFETY LOCK comprised by a mechanism (1), having a case composed of two parallel plates (2) inter connected by spacers (3), internally provided with an operating drive (4) for a latch bolt (5) and for a latch (6), this latter being also operable by a handle or the like passing throuh a corresponding opening (7), and, further, the mechanism (1) having a barrel block (8) incorporated therein, which is provided with a longitudinal hole or passage (9) to receive a puzzle barrel comprised of one or more rows of spring pin assemblies radially positioned with respect to two barrels or cylinders (10) inserted in the passage (9), each of which having an eccentric internal pin (11) configurating an interfering cam which cooperates with the operating drive (4), characterized in that the barrel block (8) is retained in the mechanism (1) by a drawer-like arrangement, said barrel block (8) being provided with a transverse channel (12) housing cam (11) completely and leaving free a wide lower section (13), and the side walls of channel (12) presenting small steps (14) along the upper edges, defined as guides (15) which are insertable in the respective aperture 16) in the mechanism (1).

2. SAFETY LOCK as claimed in claim 1, characterized in that the aperture (16) has the shape of an elongated "U" oriented in a horizontal plan; while said guides (15) of said block (8) form resting surfaces to receive between each other the upper edges (17) of aperture (16), said steps (14) remaining blocked at the lower ends of said upper edges (17), and the lower face of said barrel block (8) being supported on the inferior side (18) of aperture (16).

* * * * *